United States Patent [19]

Robinson et al.

[11] 3,933,969

[45] Jan. 20, 1976

[54] HOLLOW REINFORCED CONCRETE FENCE POST AND METHOD AND APPARATUS FOR MAKING THE SAME

[76] Inventors: Frank R. Robinson; Frank S. Robinson, both of Rte. 2, Box 336, Dallas, Oreg. 97338

[22] Filed: Apr. 15, 1974

[21] Appl. No.: 460,759

[52] U.S. Cl. ..... 264/312; 264/336; 264/DIG. 43; 425/427; 425/444

[51] Int. Cl.[2] ..... B28B 1/20

[58] Field of Search ..... 264/312, 334, 336; 425/438, 444, 425, 426, 427

[56] References Cited

UNITED STATES PATENTS

| | | | |
|---|---|---|---|
| 1,593,696 | 7/1926 | Hyden et al. | 264/312 X |
| 2,008,339 | 7/1935 | Ruml | 264/312 X |
| 2,356,852 | 8/1944 | Hutchinson | 264/312 X |
| 2,663,063 | 12/1953 | Van Loon | 264/334 X |

*Primary Examiner*—Robert F. White
*Assistant Examiner*—Thomas P. Pavelko
*Attorney, Agent, or Firm*—Klarquist, Sparkman, Campbell, Leigh, Hall & Whinston

[57] ABSTRACT

A wire reinforced hollow core concrete fence post is made by injecting concrete into a form in which is centrally supported a longitudinally extending mandrel having a plurality of radially extending spacers extending longitudinally along its surface, the spacers being adapted to support a cylindrical tube of wire mesh reinforcing remote from the surface of the mandrel. A pallet board is disposed in the bottom of the form for supporting the concrete injected therein. Means are provided to rotate the manadrel and the tube of wire mesh reinforcing while the concrete is being injected into the form. Means are also provided to withdraw the mandrel from the form after the concrete has been injected, while retaining the concrete and the reinforcing within the form. After the mandrel has been withdrawn, a pusher is engaged with the end of the mandrel to push the pallet board and the concrete in the shape of the post with the tube of wire mesh reinforcing disposed therein, out of the form and onto a pallet mounted on a movable carriage. Means are provided to move the pallet and the carriage transversely of the form to allow space for receiving a subsequent post.

An apparatus for forming the wire mesh reinforcing into a tube is also disclosed.

1 Claim, 13 Drawing Figures

HOLLOW REINFORCED CONCRETE FENCE POST AND METHOD AND APPARATUS FOR MAKING THE SAME

BACKGROUND OF THE INVENTION

This invention relates to hollow reinforced concrete fence posts and a method and apparatus for making the same.

Fence posts have traditionally been made of wood or metal. Wooden fence posts are combustible and are also subject to rot. Wooden posts thus require painting and other periodic maintenance, which is costly and time consuming. Metal fence posts often bend in use and if made of iron as is usually the case, require periodic painting to prevent rust.

Fence posts have been made from concrete, but those available have been solid and thus quite heavy. Solid concrete posts are made by pouring concrete into a mold, and this method of manufacture is, of course, slow and costly.

It is thus the primary object of the present invention to provide a fence post that does not rot, rust or burn, that is strong and durable and requires a minimum of maintenance.

It is a further object of the present invention to provide a concrete fence post that is hollow, wire reinforced, light in weight, strong and durable.

It is a still further object of the present invention to provide a wire reinforced hollow core concrete fence post that can be quickly and inexpensively manufactured.

It is a still further object of the present invention to provide a method and apparatus for making such fence posts.

SUMMARY OF THE INVENTION

Our reinforced concrete fence post comprises a rectangular parallelepiped of concrete having a central longitudinal cylindrical hollow core and a cylindrical tube of wire mesh reinforcement disposed between the core and the exterior surfaces of the post. The post further comprises a plurality of radial slots extending outwardly from said core into said post to about the location of the wire reinforcement. Optionally, our fence post may be provided with a plurality of transversely extending ridges on one of its exterior surfaces, and these ridges may be used to support barbed or other wire extending between adjacent fence posts.

Our apparatus for making wire reinforced hollow concrete fence posts comprises a form having the general external shape of a fence post to be made and a longitudinally extending mandrel centrally supported in the form and having a plurality of radially extending spacers extending longitudinally along its surface. The spacers are adapted to support a cylindrical tube of wire mesh in a manner such that the mesh is remote from the generally cylindrical surface of the mandrel.

Means are provided to inject concrete into the form between the mandrel and the form, and means are provided simultaneously to rotate the mandrel and the tube of wire mesh while the concrete is being injected into the form.

Means are further provided to withdraw the mandrel from the form after the concrete has been injected while retaining the concrete and the tube of wire mesh within the form. Finally, means are provided to push the concrete with the tube of wire mesh disposed therein out of the form and onto a receiving means.

Our invention further provides a method and apparatus for making the required wire reinforcing. Such apparatus comprises a spindle having a longitudinally extending slot disposed in its exterior surface, the slot being adapted to receive a longitudinal edge of a sheet of such wire mesh reinforcing. Guide means are provided adjacent the spindle and means are provided to rotate the spindle to cause the slot to bend the sheet and form an interiorly extending projection and the guide means to wrap or form the sheet of wire mesh around the spindle and partially overlap the same.

Spot welding of the overlapped portions of the mesh at spaced intervals provides a cylindrical tube having a radially and interiorly extending projection extending longitudinally of the tube. After an end cap of wire mesh is spot welded on one end of the tube so constructed, the latter is pulled off the spindle and is then ready for use in making a fence post.

Our method of making wire reinforced hollow concrete fence posts comprises placing a mandrel in a form having the general external shape of a fence post to be made, placing a cylindrical tube of wire mesh over the mandrel and supporting the tube on a plurality of radially extending spacers which extend longitudinally along the surface of the mandrel. Concrete is then injected into the form between the mandrel and the form while simultaneously rotating both the mandrel and the tube of wire mesh reinforcing, the injecting of concrete continuing until the space between the mandrel and the form is filled. The method further comprises withdrawing the mandrel from the form while retaining the concrete and the tube of wire mesh in the form, and then pushing the concrete and the tube of wire mesh out of the form onto a receiving means.

DESCRIPTION OF THE PREFERRED EMBODIMENT

Fence Post Making Machine

Figure 5:
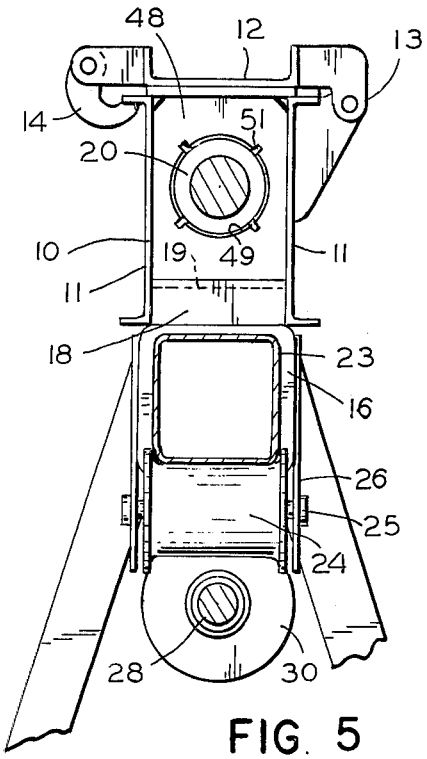
FIG. 5 is an elevational view taken on line 5—5 of FIG. 4.

Our fence post making machine comprises a form box 10 having sides 11 and a lid 12 attached to one of the sides 11 by hinges 13 and secured by a latch 14 operated by a lever 15. The box 10 is mounted on a five inch square metal tube 16 supported by legs in the form of metal channel members 17 adjacent its ends. The box 10 is preferably made to have interior dimensions four and one-half inches square by 84 inches long, as such is a desired size for fence posts.

Figure 1:
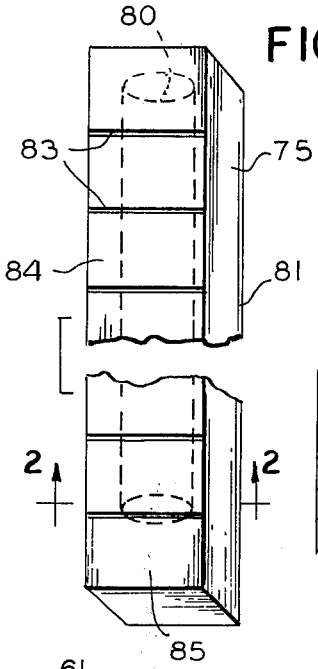
FIG. 1 illustrates a perspective view of a wire reinforced hollow core concrete fence post made according to the present invention.
Figure 2:
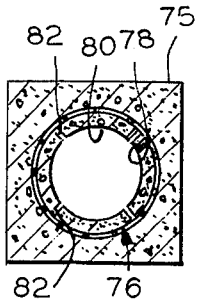
FIG. 2 is a cross-sectional view of the fence post taken on line 2—2 of FIG. 1.

A removable wooden pallet board 18, preferably four and one-half inches wide, one and one-quarter inches thick and 84 inches long, is provided for insertion in the bottom of the form box 10 between the sides 11. The board 18 may be smooth on both sides or it may have transversely extending grooves 19 at any desired spacing on one side so to form transversely extending ridges 83 on the corresponding exterior surface of the post 75 which rests adjacent the board 18 when the concrete is injected into the form box 10. See FIG. 1. A desired construction for the pallet board 18 is to have one side smooth and the opposite side grooves as aforesaid, such that either a ridged surface or a smooth surface may selectively be provided for the post.

A two and one-half inch nominal diameter steel mandrel 20 disposed centrally of the form box 10 is mounted in bearings 21 on a bracket 22 supported on a four inch square metal tube 23. The tube 23 is slidably received within the five inch tube 16 and is supported by roller bearings 29 inside the tube 16 and by an external roller 24 journaled on a shaft 25 supported by arms 26 attached to the sides of the tube 16. The four inch tube 23 is itself attached to a bracket 27 mounted on the end of a piston rod 28 received in a hydraulic cylinder 30 mounted underneath the tube 16 and operated by a control lever 37 which actuates a hydraulic control box 31 to cause flow from a hydraulic pump 32 selectively through hydraulic lines 33, 34 to extend and retract the rod 28 and thus the tube 23 and mandrel 20 as required. The hydraulic pump 32 is operated by an electric motor 35 through a power transmission belt 36, power for the motor 35 being supplied through a power box 38 and controlled by a switch 39.

A second electric motor 40 mounted on the bracket 22 and controlled by a switch 44 transmits power by a one-to-one belt drive 41 through a 15.5-to-1 link belt reduction gear box 42 and thence to a one-to-one chain drive 43 to rotate the mandrel 20 in the bearings 21.

Four one-half inch by one-eighth inch thick radially extending metal spacers 46 are attached at 90 degree intervals to the surface of the mandrel 20 and extend longitudinally along its entire length except for a small interruption or space 47 adjacent the outboard end of the mandrel. The spacers 46 are adapted to support the wire mesh reinforcing away from the surface of the mandrel 20. A removable end plate 48 having a centrally disposed circular aperture 49 of a size to receive the mandrel 20 and four radially extending slots 51 to accommodate the spacers 46 is positioned in the form box 10 abutting a pair of stops 52 adjacent the end thereof, the stops 52 being so located that when the mandrel 20 is fully disposed within the form box 10, the end plate 48 is received in the spaces 47 within the spacers 46 to permit rotation of the mandrel 20 inside the form box 10 free of obstruction by the end plate 48. The spacers 46 on the mandrel 20, of course, must be aligned with the slots 51 in the end plate 48 when it is desired to withdraw the mandrel 20 out of the form box 10.

A removable end plate 54 is provided for the other end of the form box 10 and is received in brackets 55 attached thereto. The plate 54 has a centrally disposed aperture 56 adapted to receive the outlet hose 57 of a concrete pump (not shown) for injecting concrete into the form between the mandrel 20 and the sides 11 upon actuation of a switch 58. Slop shields 59 are provided to protect the apparatus from concrete spillage.

Figure 6A:
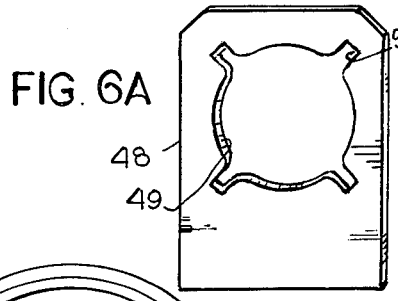
FIG. 6A is a perspective view to an enlarged scale of a removable end plate used in the apparatus.
Figure 6:
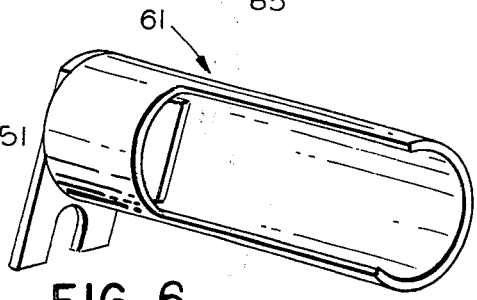
FIG. 6 is a perspective view of apparatus used to push the concrete post out of the form box.

A push out shoe 61 is provided for reception on the end of the mandrel 20 when the same is fully withdrawn from the form box 10. See FIG. 6. The shoe 61 is adapted to push on the end plate 48 to push the pallet board 18 with a concrete post thereon out of the form box when the hydraulic control level 37 is positioned so as to reverse the flow of hydraulic fluid through the lines 33, 34 and cause the piston rod 28 to be retracted into the hydraulic cylinder 30.

CONCRETE POST RECEIVING APPARATUS

A receiving means in the form of apparatus 62 comprising a movable pallet 63 is positioned adjacent the egress end 64 of the form box 10 for receiving the pallet board 18 and concrete post when the same have been pushed out of the form box 10 as above described. The apparatus 62 includes a roller mounted carriage 65 mounted on guide rails 66 and supporting the pallet 63 which is positioned between guide brackets 67. A skid plate 68 is mounted on the pallet 63 to facilitate removal of the pallet boards 18 and posts.

A second hydraulic cylinder 70 is mounted adjacent the apparatus 62 and is connected to the hydraulic control box 31 by hydraulic lines 71, 72 as shown. Operation of a control lever 73 causes the control box 31 to cause flow from the hydraulic pump 32 selectively through the lines 71, 72 to move the pallet 63 and the carriage 65 on the rails 66 transversely of the form box 10 a distance of approximately five inches to allow space for a subsequent concrete post to be pushed out of the form box 10.

OPERATION OF THE FENCE POST MAKING MACHINE

To make a hollow core concrete fence post 75 in our fence post making machine, the end plate 54 is removed from its holding brackets 55 and the lid 12 is opened by releasing the lid latch lever 15. The removable end plate 48 is slid along the mandrel 20 and positioned against the stops 52 at the left-hand end of the machine as seen in the drawings. A pallet board 18 is slid into the bottom of the form box 10 between its sides 11 and underneath the mandrel 20 for supporting the post that is formed thereon. As previously mentioned, the board 18 may have a smooth side up or a grooved side up, depending whether a smooth or a ridged surface is ultimately desired for the post under construction.

A tube 76 of wire mesh reinforcing constructed as hereinafter to be described and having an end cap 79 is pushed onto the mandrel 20 with its inner surface 77 in contact with the spacers 46 until the tube 76 hits the end plate 48. The lid 12 is shut and latched and the end plate 54 is slid down into its receiving brackets 55 to close the form box 10.

The switch 44 for the motor 40 is turned on causing the mandrel 20 to rotate in the bearings 21. This also causes the reinforcing tube 76 to rotate by virtue of the fact that an interiorly extending projection 78 engages one of the spacers 46 on the mandrel 20 as the latter is caused to rotate. Switch 58 is actuated to turn the concrete pump "on" and pump concrete into the form box 10 between the mandrel 20 and the form itself. Rotation of the reinforcing tube 76 together with the mandrel 20 causes the concrete thoroughly to fill the interstices in the reinforcing mesh. When the form is full, the concrete pump is shut off and the motor 40 is shut off next, thus stopping rotation of the mandrel 20 and reinforcing tube 76.

The motor 35 is then started to actuate the hydraulic pump 32. The control lever 37 is moved to extend the rod 28 out of its cylinder 30 and thus pull the mandrel 20 out of the form box 10. The spacers 46 as mentioned previously must be aligned with the slots 51 in the end plate 48 so that the mandrel 20 freely can slip through the end plate 48. The stops 52 restrain the end plate 48 from being similarly withdrawn from the form box and the end plate 48 keeps the concrete and reinforcing tube 76 inside on the pallet board 18.

When the piston rod 28 is fully extended and the mandrel 20 fully extracted from the form box, the push out shoe 61 is slipped over the right-hand end of the mandrel. The end plate 54 is slipped up out of its brackets 55 and the concrete hose 57 is removed. The control lever 37 for the hydraulic system is then actuated to retract the piston rod 28 into its cylinder 30 and thus cause the mandrel 20 and the push out shoe 61 to push on the end plate 48, thereby to push the fence post that has been formed (with the wire mesh reinforcing 76 in place) and the pallet board 18 which is underneath, out of the form box and onto the movable pallet 63. The hydraulic control lever 73 is actuated to move the pallet carriage 65 an incremental distance of approximately five inches to clear a space for the next post to be made, thus completing a manufacturing cycle.

We have found that a desirable cement mix to use is one consisting of one bag of Kaiser Permanent High Early Strength Portland Cement Type III mixed with one bag of Flint Coat Calaverous Base Type IIA Plastic Cement. One part of this cement mixture is mixed with three parts of sand, using just enough water to make the mix plastic but with a minimum slump. The plastic cement contains an air entraining agent which makes it resistant to freeze damage, and we have found this especially desirable for fence posts.

We cure our fence posts preferably in a steam room (not shown) having aluminum siding on the inside and one inch thick sheet Styrofoam brand plastic on the outside for insulation. The steam room we use is large enough to accommodate 100 concrete posts on a steel rack. Our curing consists of an initial delay after casting of from 2 to 5 hours. Such allows an initial hydration to start. The steam is then turned on in the steam room such that the temperature does not rise more than about 30° to 45° per hour up to a maximum of between about 145° and 165°F. We maintain this temperature for about 8 hours. The steam is then shut off and the posts are allowed to cool. This curing gives at least 65 percent of 28-day strength in 24 hours.

Operation of the machine as described makes concrete posts 75 up to 7 feet long and four and one-half inches square with a two and three-fourth inch hollow core 80 in the middle and a reinforced end 85 on one end as shown. The posts weigh between about 75 and 80 pounds each and have been found to be extremely strong and durable. Use of the spacers 46 on the mandrel 20 causes the wire mesh reinforcement 76 to be disposed between the core 80 and the exterior surfaces 81 of the post where it does the most good. The spacers 46 also cause the formation of radial slots 82 extending outwardly from the core 80 into the post to about the location of the wire reinforcement 76. If a grooved pallet board 18 is used, a plurality of transversely extending ridges 83 are formed on one of the exterior surfaces 84 of the post, and these ridges may be used to support barbed or other wire extending between adjacent posts.

WIRE WRAPPING MACHINE

Figure 9:
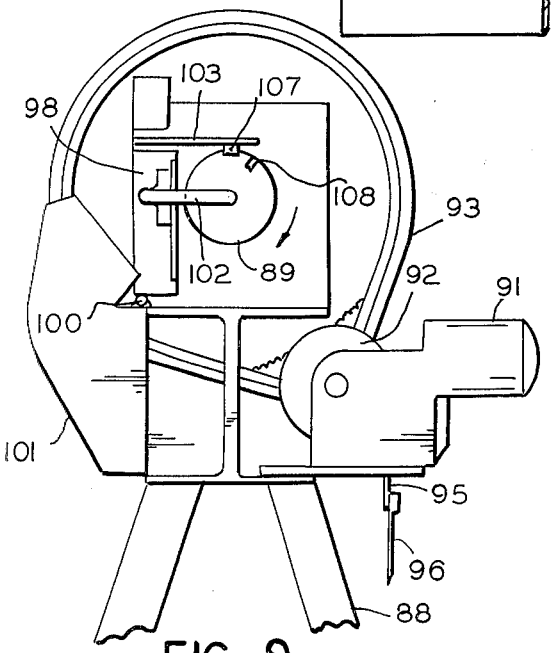
FIG. 9 is an end elevational view of the apparatus shown in FIGS. 7 and 8.
Figure 12:
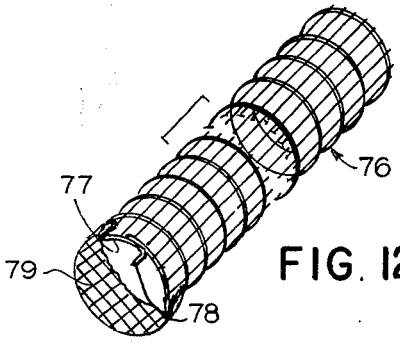
FIG. 12 is a perspective view of the completed wire mesh reinforcing for the fence post of the instant invention.
Figure 7:
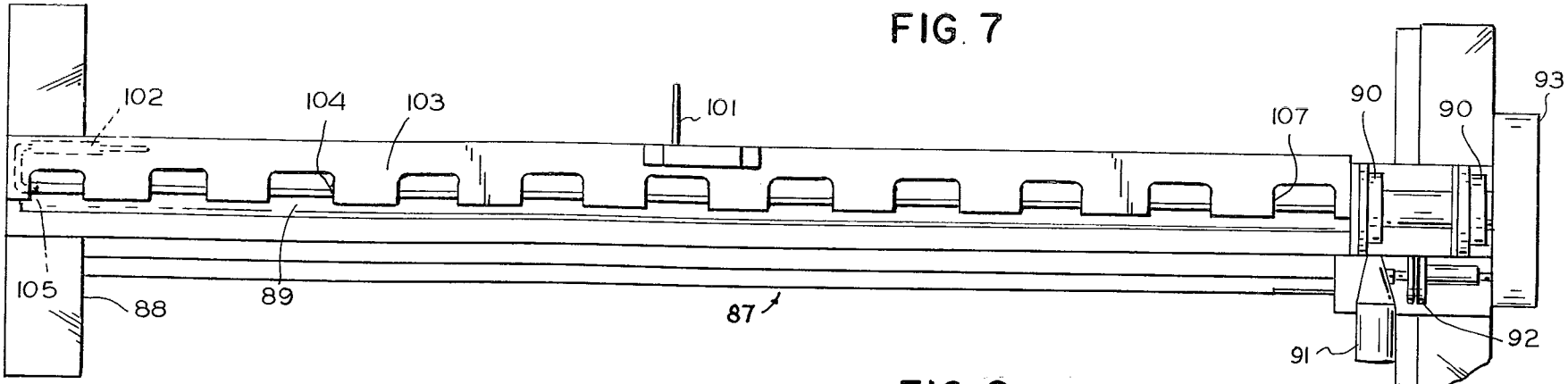
FIG. 7 is a plan view of the wire wrapping apparatus.
Figure 8:
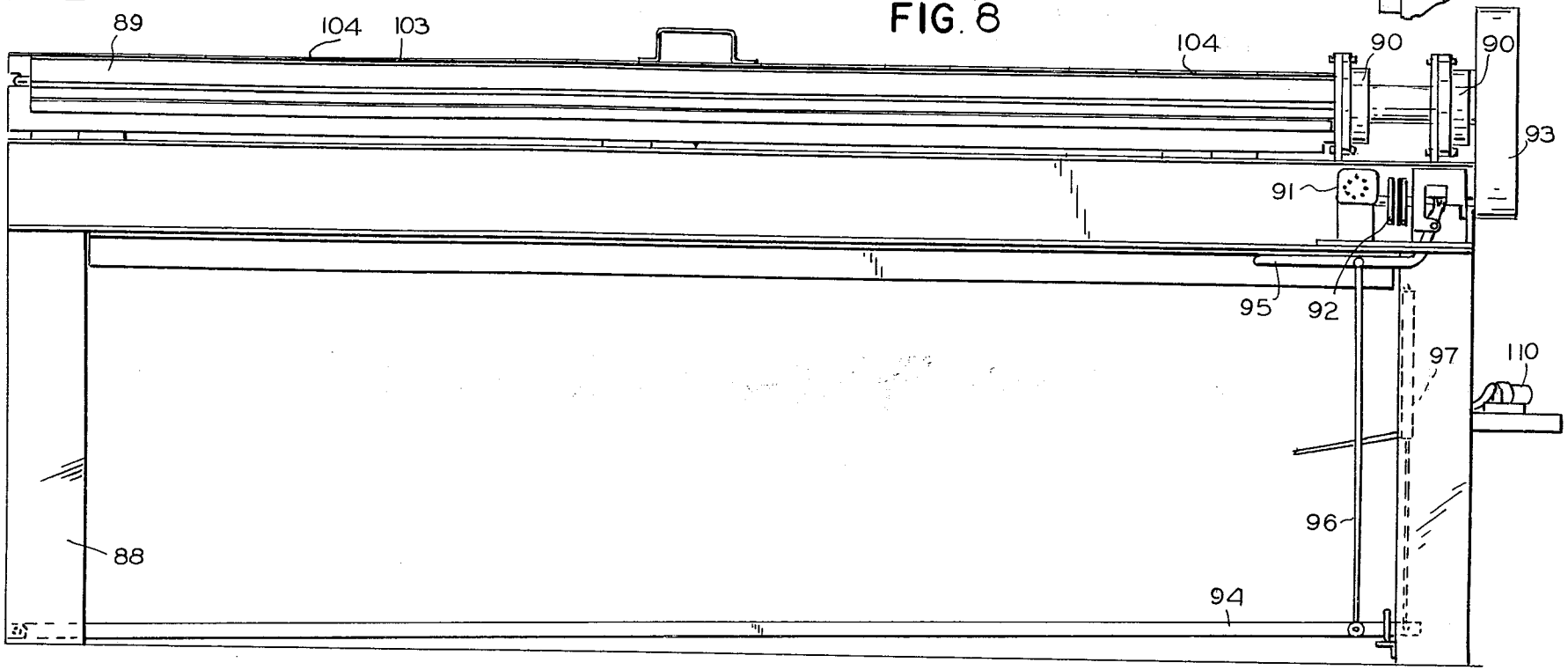
FIG. 8 is a side elevational view of the apparatus of FIG. 7.

Our wire wrapping machine 87 (see FIGS. 7–9) comprises a support frame 88 in which a wire wrapping spindle 89 is journaled in end support bearings 90 as shown. The spindle 89 is rotated by a gear head motor 91 through a disc clutch and brake 92 and chain drive 93. A foot operated treadle 94 pivotally connected to a clutch arm 95 by a link 96 and restrained by a return spring 97 causes engagement of the clutch and rotation of the spindle 89. Release of the treadle 94 causes the spring 97 to release the clutch and cause the spring loaded brake automatically to restrain the spindle in the released position.

Guide means in the form of a channel iron support 98 pivotally mounted at 100 supports a removable end support bearing 102 on which the spindle 89 rotates. A presser bar 103 having longitudinally disposed access openings 104 for spot welding access is mounted on the top of the channel iron support 98, thereby to be able to rotate with the channel iron support 98 away from the spindle 89 when the end support bearing 102 is removed from a receiving aperture 105 in the end of the spindle 89. This allows the channel iron support 98 and the presser bar 103 to swing back against the stop 101 so that wire mesh reinforcing wrapped around the spindle 89 and spot welded together can be removed.

The spindle 89 is provided with an embedded longitudinally extending copper strip 107 to facilitate the spot welding above mentioned and a longitudinally extending radial slot 108 positioned about 30 degrees from the copper strip 107 to receive the longitudinal edge of a sheet 109 of wire mesh reinforcing for wrapping about the spindle 89 as will be described. Spot welding controls including a solenoid 110 are provided for spot welding apparatus, not shown.

OPERATION OF THE WIRE WRAPPING MACHINE

Figure 10:
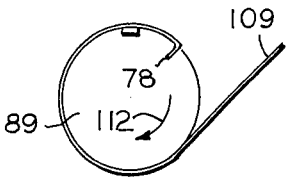
FIG. 10 is a schematic view illustrating the method of wrapping the wire around the spindle in the apparatus of FIGS. 7–9.

The gear head motor 91 is turned "on" and a longitudinal edge of a sheet 109 of wire mesh reinforcing approximately 13½ inches by 84 inches in size is inserted into the slot 108 in the wire wrapping spindle 89, which slot 108 has previously been rotated sufficiently from top dead center to clear the presser bar 103. The clutch treadle 94 is pushed down to cause the clutch 92 to engage and rotate the spindle 89 in the direction of the arrow 112 in FIGS. 9–11. This causes the sheet 109 to rotate around the spindle 89, impinging upon the channel iron support 98 and presser bar 103, and being formed into the tube 76, the slot 108 bending the sheet to form the interiorly extending projection 78. See FIGS. 10 and 11.

Figure 11:
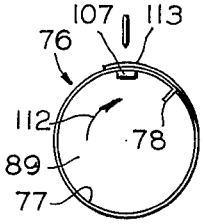
FIG. 11 is a further schematic view illustrating the sheet of wire mesh reinforcing completely wrapped around the spindle of the apparatus of FIGS. 7–9 and in position to be spot welded along its overlapped portions.
Figure 3:
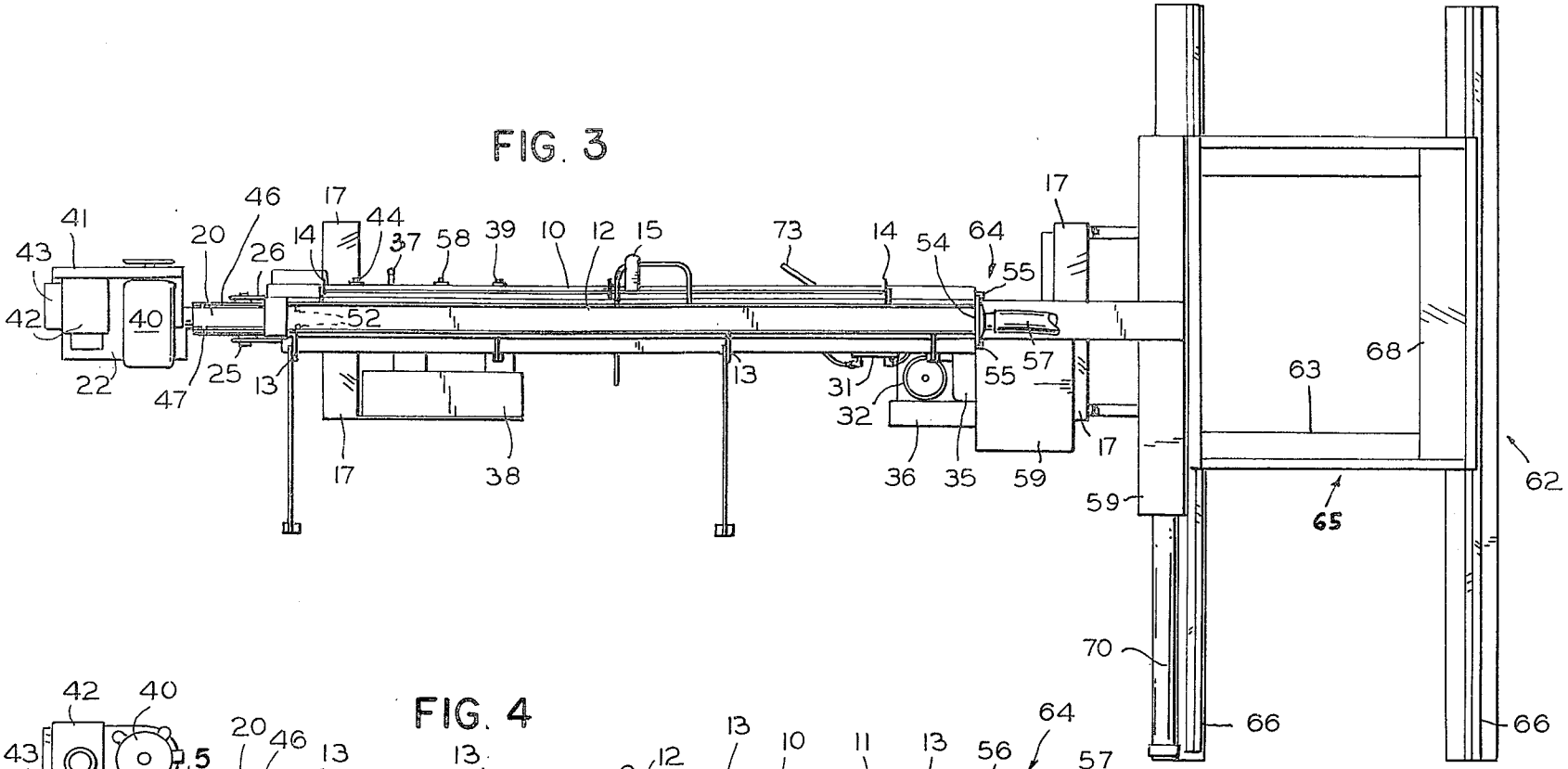
FIG. 3 is a plan view of our fence post making apparatus.
Figure 4:
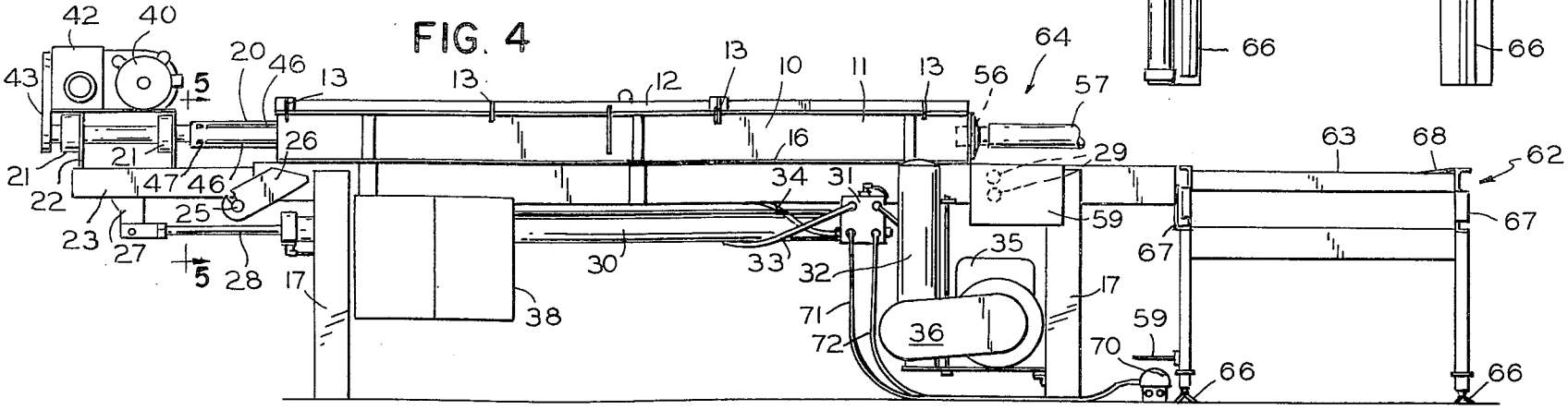
FIG. 4 is a side elevational view of the apparatus of FIG. 3.

When the sheet of wire mesh has rotated sufficiently to cause an overlap 113 to be formed, as shown in FIG. 11, and the copper strip 107 is at top dead center of the spindle 89, the clutch treadle 94 is released and the spring loaded brake automatically applied to hold the spindle 89 in the released position. A spot welder is then used to spot weld the overlapped mesh at spaced intervals corresponding to the access openings 104 in the presser bar 103, the copper strip 107 directly underneath permitting fusion of the wire mesh but protecting the spindle 89. We have found that placing the tips of the spot welder approximately two inches apart on top of the lapped material creates an adequate joining of the mesh to form the tube 76. Spot welding is repeated all along the presser bar 103 in each of the access openings 104 from one end of the spindle 89 to the other.

After the spot welding operation is completed, the end support bearing 102 is pulled out of the aperture 105 in the end of the spindle 89, and this permits the channel iron support 98 and presser bar 103 to be swung back against the stop 101. An end cap 79 of wire mesh is spot welded on one end of the tube 76 and the assembly is then pulled off the spindle. The channel iron support 98 and presser bar 103 are then rotated adjacent to the spindle 89, the end support bearing 102 is replaced in the aperture 105, and the apparatus is ready to wrap another sheet of wire mesh into a tube.

We have found that a desirable type of wire mesh reinforcing material is provided by the Western Metal Lath Division of Republic Corporation and is sold under the brand name Diamond. It is a painted copper alloy steel mesh and we have found either 2.5 or 3.4 pounds per square yard to be a satisfactory weight. The mesh comes in sheets 27 inches by 96 inches in size, which are cut down to the required 13½ inch by 84 inch sheets to make the 7 foot long posts.

The tube 76 of wire mesh reinforcing which is thus formed has an interiorly extending projection 78 caused by the slot 108, which projection can then be used to engage one of the spacers 46 on the mandrel 20, thereby to cause the tube to rotate with the mandrel 20 during injection of the concrete. The provision of the end cap 79 allows the formation of a post with a reinforced end 85 as above described.

We claim:

1. A method of making wire reinforced hollow concrete fence posts, comprising placing a mandrel in an elongated horizontally positioned form having the general external shape of a fence post to be made;

placing a cylindrical tube of wire mesh over said mandrel and supporting said tube remote from the surface of said mandrel on spacers attached longitudinally to said surface of said mandrel, said tube being formed with means for engaging said spacers on said surface of said mandrel upon rotation thereof;

injecting concrete into said form between said mandrel and said form while simultaneously rotating said mandrel together with said tube of wire mesh, said tube being rotated with said mandrel by positive engagement of one of said spacers on said surface of said mandrel with said engaging means on said tube, said form remaining stationary, to cause said concrete thoroughly to fill the interstices in said mesh, said injecting and said rotating continuing until the space between said mandrel and said form is filled with said concrete;

longitudinally withdrawing said mandrel from said form while retaining said concrete and said tube of wire mesh within said form; and pushing said concrete and said tube of wire mesh longitudinally out of said form onto a receiving means, said mesh supporting said concrete until the same has set.

* * * * *